US007643993B2

(12) United States Patent
Heiman

(10) Patent No.: US 7,643,993 B2
(45) Date of Patent: Jan. 5, 2010

(54) METHOD AND SYSTEM FOR DECODING WCDMA AMR SPEECH DATA USING REDUNDANCY

(75) Inventor: Arie Heiman, Rannana (IL)

(73) Assignee: Broadcom Corporation, Irvine, CA (US)

( * ) Notice: Subject to any disclaimer, the term of this patent is extended or adjusted under 35 U.S.C. 154(b) by 760 days.

(21) Appl. No.: 11/325,721

(22) Filed: Jan. 5, 2006

(65) Prior Publication Data

US 2007/0156402 A1 Jul. 5, 2007

(51) Int. Cl.
*G10L 19/14* (2006.01)

(52) U.S. Cl. ..... 704/242; 704/200; 704/221; 704/220

(58) Field of Classification Search ..... 704/242, 704/200, 220, 221
See application file for complete search history.

(56) References Cited

U.S. PATENT DOCUMENTS

| | | | | |
|---|---|---|---|---|
| 5,710,784 | A * | 1/1998 | Kindred et al. | 375/262 |
| 6,768,727 | B1 * | 7/2004 | Sourour et al. | 370/335 |
| 6,917,629 | B1 * | 7/2005 | Ramesh et al. | 370/509 |
| 2002/0198708 | A1 * | 12/2002 | Zak et al. | 704/233 |
| 2007/0067164 | A1 * | 3/2007 | Goudar | 704/219 |

OTHER PUBLICATIONS

"Univeral Mobile Telecommunications System (UMTS); Physical channels and mapping of transport channels onto physical channels (FDD)." ETSI TS 125 211 V6.7.0 (Dec. 2005), Technical Specification.

"Universal Mobile Telecommunications System (UMTS); Multiplexing and channel coding (FDD)." ETSI TS 125 212 V6.7.0 (Dec. 2005), Technical Specification.

"Universal Mobile Telecommunications System (UMTS); Services provided by the physical layer." ETSI TS 125 302 V6.5.0 (Sep. 2005), Technical Specification.

* cited by examiner

*Primary Examiner*—Qi Han
(74) *Attorney, Agent, or Firm*—McAndrews, Held & Malloy, Ltd.

(57) ABSTRACT

A method and system for decoding WCDMA AMR speech data using redundancy may include generating at least one bit-sequence for at least one of a plurality of channels that comprises received WCDMA speech data. The bit-sequence may be generated by using a decoding algorithm and may be decrypted to recover the data that may have been encrypted before being transmitted. At least one bit-sequence may be selected for each of the channels by using redundancy, such as, for example, CRC, in the received WCDMA speech data. The redundancy in the received WCDMA speech data may be, for example, CRC. The bit-sequence for each of the channels may be combined to form at least one speech stream. A speech stream may be selected based on speech constraints, which may comprise gain continuity and/or pitch continuity. The selected speech stream may be communicated to a voice decoder.

30 Claims, 14 Drawing Sheets

METHOD AND SYSTEM FOR DECODING WCDMA AMR SPEECH DATA USING REDUNDANCY

CROSS-REFERENCE TO RELATED APPLICATIONS/INCORPORATION BY REFERENCE

This application makes reference to, claims priority to, and claims benefit of U.S. Provisional Application Ser. No. 60/752,705 filed on Dec. 21, 2005.

This application makes reference to:

U.S. application Ser. No. 11/326,066 filed on Jan. 5, 2006;

U.S. application Ser. No. 11/189,509 filed on Jul. 26, 2005; and

U.S. application Ser. No. 11/189,634 filed on July 26, 2005.

Each of the above stated applications is hereby incorporated herein by reference in its entirety.

FIELD OF THE INVENTION

Certain embodiments of the invention relate to wireless communication systems. More specifically, certain embodiments of the invention relate to a method and system for decoding WCDMA AMR speech data using inherent redundancy.

BACKGROUND OF THE INVENTION

In some conventional receivers, improvements may require extensive system modifications that may be very costly and, in some cases, may even be impractical. Determining the right approach to achieve design improvements may depend on the optimization of a receiver system to a particular modulation type and/or to the various kinds of noises that may be introduced by a transmission channel. For example, the optimization of a receiver system may be based on whether the signals being received, generally in the form of subsequent symbols or information bits, are interdependent. Signals received may be interdependent signals, that is, signals with memory. For example, NRZI may be used when it is desirable for the receiver to synchronize to the received signal via an embedded clock in the received signal. Accordingly, a received bit in a NRZI modulated transmission may depend on demodulation of the previous bit.

One method or algorithm for signal detection in a receiver system that decodes convolutional encoded data is maximum-likelihood sequence estimation (MLSE). The MLSE is an algorithm that performs soft decisions while searching for a sequence that minimizes a distance metric in a trellis that characterizes the memory or interdependence of the transmitted signal. In this regard, an operation based on the Viterbi algorithm may be utilized to reduce the number of sequences in the trellis search when new signals are received.

However, one drawback may be that a bit-sequence chosen via, for example, the Viterbi algorithm may not satisfy specific constraints of a system. For example, a bit-sequence chosen as the most likely candidate for an application data via a Viterbi algorithm may not satisfy application constraints.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A method and/or system for decoding WCDMA AMR speech data using redundancy, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Certain embodiments of the invention provide a method and system for decoding WCDMA AMR speech data using inherent redundancy. Aspects of the method may comprise generating at least one bit-sequence for at least one of a plurality of channels, for example, three channels, that may comprise received WCDMA speech data. The bit-sequence may be generated by using a decoding algorithm, for example, a Viterbi algorithm. The bit-sequences may be decrypted to recover the data that may have been encrypted before being transmitted. At least one bit-sequence may be selected for each of the channels, where at least one of the bit-sequences may be selected using redundancy in the received WCDMA speech data. The redundancy in the received WCDMA speech data may be, for example, CRC. The bit-sequence for each of the plurality of channels may be combined to form at least one speech stream. A speech stream may be selected based on speech constraints, which may comprise gain continuity and/or pitch continuity. The selected speech stream may be communicated to a voice decoder.

At least one junction may be selected in a bit-sequence generated by the Viterbi algorithm. At least one source metric parameter may be used to select a junction, where the metric parameter may be a channel metric and/or a physical constraint metric. Other bit-sequences may be generated from this bit-sequence by performing a search starting from at least one of the selected junctions. The generated bit-streams may be verified by a corresponding redundancy verification parameter, which may be, for example, a CRC. The corresponding redundancy verification parameter for each of the bit-sequences may be simultaneously generated with trace back pointers, so that the trace back pointer may be used to perform the search from a junction. The number of CRC calculations, and hence, the number of bit-sequences, may be limited. This may allow an upper-limit on the number of different bit-sequences that may be searched.

Figure 1A:
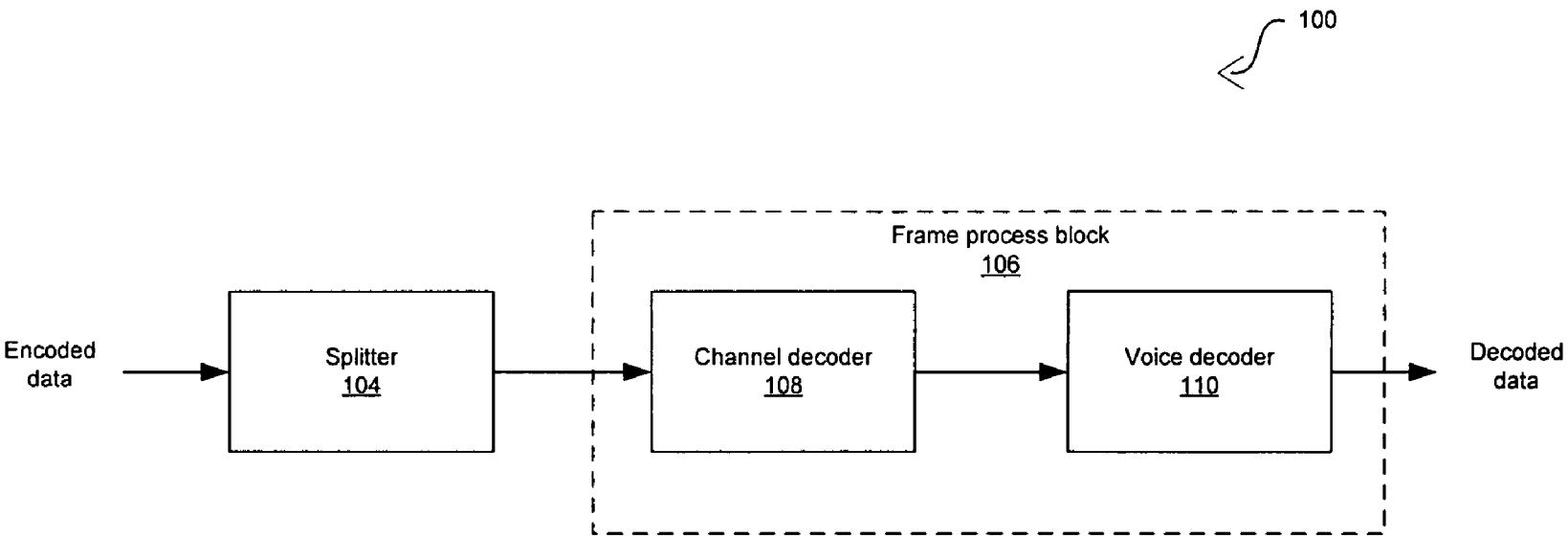
FIG. 1A is a block diagram illustrating an exemplary system for processing WCDMA speech data, in accordance with an embodiment of the invention.

FIG. 1A is a block diagram illustrating an exemplary system for processing WCDMA speech data, in accordance with an embodiment of the invention. Referring to FIG. 1A, there is shown a receiver 100 that comprises a splitter 104 and a frame process block 106. The frame process block 106 may comprise a channel decoder 108 and a voice decoder 110. The receiver 100 may comprise suitable logic, circuitry, and/or code that may operate as a wireless receiver. The receiver 100 may comprise suitable logic, circuitry, and/or code that may operate as a wireless receiver. The receiver 100 may be utilize redundancy to decode interdependent signals, for example, signals that comprise convolutional encoded data.

The splitter 104 may comprise suitable logic, circuitry, and/or code that may enable splitting of received bits to two or three channels to form the frame inputs to the frame process block 106.

The channel decoder 108 may comprise suitable logic, circuitry, and/or code that may enable decoding of the bit-sequences in the input frames received from the splitter 104. The channel decoder 108 may utilize the Viterbi algorithm to improve the decoding of the input frames. The voice decoder 110 may comprise suitable logic, circuitry, and/or code that may perform voice-processing operations on the results of the channel decoder 108. Voice processing may be adaptive multi-rate (AMR) voice decoding for WCDMA or from other voice decoders, for example.

Regarding the frame process operation of the decoder 100, a standard approach for decoding convolution-encoded data is to find the maximum-likelihood sequence estimate (MLSE) for a bit-sequence. This may involve searching for a sequence X in which the conditional probability P(X|R) is a maximum, where X is the transmitted sequence and R is the received sequence, by using, for example, the Viterbi algorithm. In some instances, the received signal R may comprise an inherent redundancy as a result of the encoding process by the signals source. This inherent redundancy, for example, a CRC and/or continuity of some speech parameters such as pitch, may be utilized in the decoding process by developing a MLSE algorithm that may meet at least some of the physical constrains of the signals source. The use of physical constraints in the MLSE may be expressed as finding a maximum of the conditional probability P(X|R), where the sequence X meets a set of physical constraints C(X) and the set of physical constraints C(x) may depend on the source type and on the application. In this regard, the source type may be speech source type.

Physical constraints for speech applications may include, for example, gain continuity and smoothness in inter-frames or intra-frames, pitch continuity in voice inter-frames or intra-frames, and/or consistency of line spectral frequency (LSF) parameters that are utilized to represent a spectral envelope. Gain continuity refers to changes in signal gain between successive signals that may exceed a threshold. Smoothness refers to changes in signal characteristics between successive signals that may exceed a threshold.

Figure 1B:
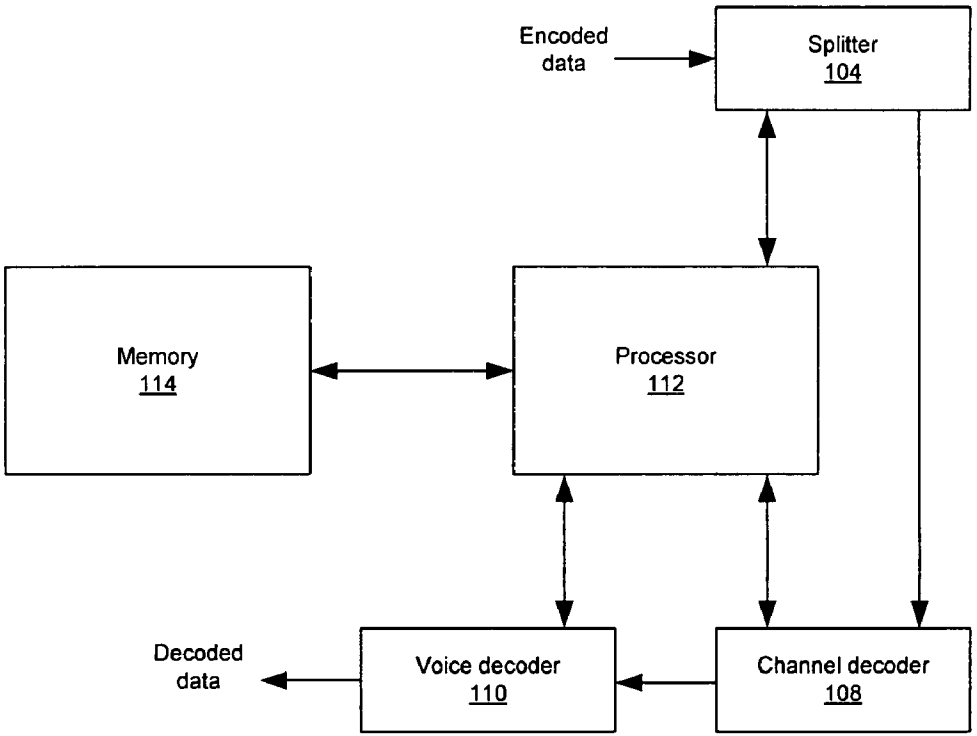
FIG. 1B is a block diagram illustrating an exemplary system for processing WCDMA speech data with a processor and memory in a multilayer process, in accordance with an embodiment of the invention.

FIG. 1B is a block diagram illustrating an exemplary system for processing WCDMA speech data with a processor and memory in a multilayer process, in accordance with an embodiment of the invention. Referring to FIG. 1B, there is shown a processor 112, a memory 114, the splitter 104, the channel decoder 108, and the voice decoder 110. The processor 112 may comprise suitable logic, circuitry, and/or code that may perform computations and/or management operations. The processor 112 may also communicate and/or control at least a portion of the operations of the splitter 104, the channel decoder 108, and the voice decoder 110. The memory 114 may comprise suitable logic, circuitry, and/or code that may store data and/or control information. The memory 114 may be adapted to store information that may be utilized and/or generated by the splitter 104, the channel decoder 108, and/or the voice decoder 110. In this regard, information may be transferred to and from the memory 114 via the processor 112, for example.

Figure 2A:
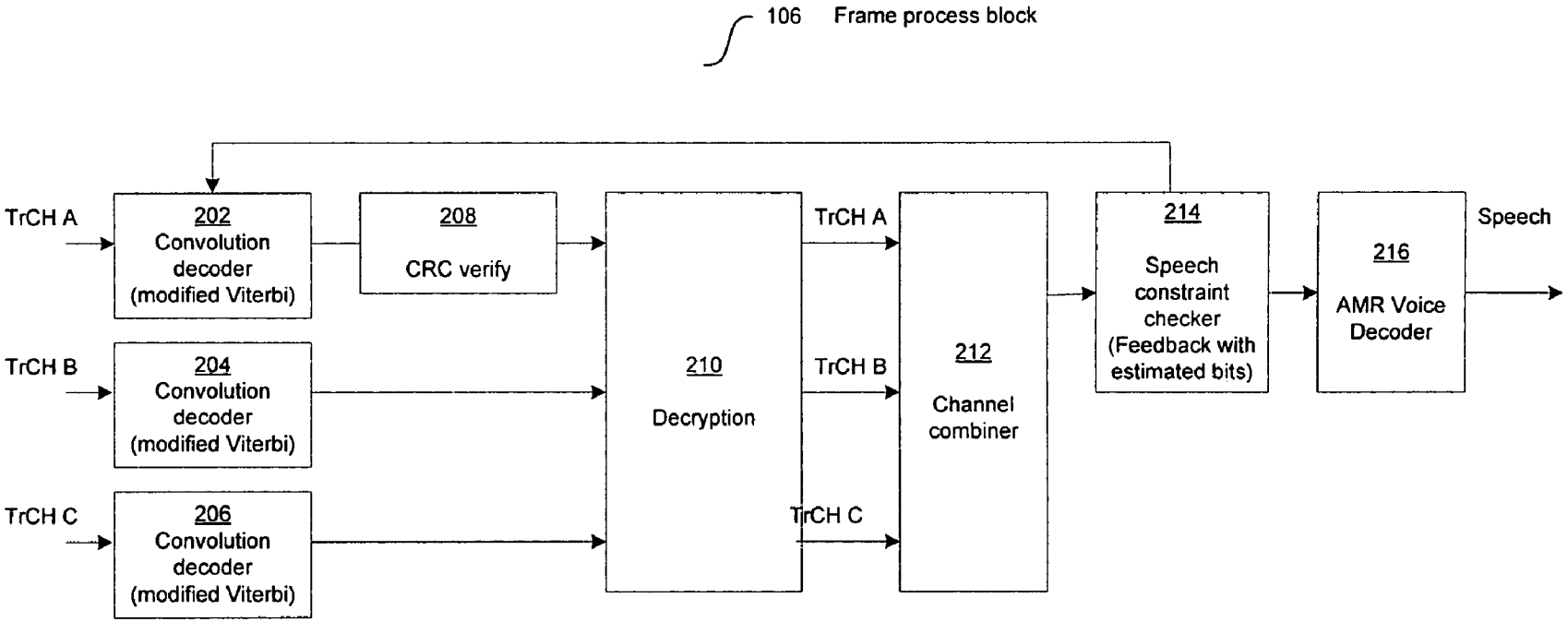
FIG. 2A is a block diagram illustrating a frame process block shown in FIG. 1A, which may be utilized in connection with an embodiment of the invention.

FIG. 2A is a block diagram illustrating a frame process block, which may be utilized in connection with an embodiment of the invention. Referring to FIG. 2A, there is shown the frame process block 106 that may comprise convolution decoder blocks 202, 204, and 206, a CRC verification block 208, a decryption block 210, a channel combiner block 212, a speech constraint checker 214, and an adaptive multi-rate (AMR) voice decoder block 216.

The convolution decoder blocks 202, 204, and 206 may comprise suitable logic, circuitry, and/or code that may enable decoding of a data stream. The convolution decoder blocks 202, 204, and 206 may use, for example, a modified Viterbi algorithm. The data stream may be, for example, a portion of WCDMA speech data that may have been received by the receiver 100. The speech data may have been convolution coded by a WCDMA transmitter. The received WCDMA speech data may comprise three channels, for example, A, B, and C, as required by the WCDMA standard. The channels A and B may have been encoded with a convolution code rate of, for example, 1/3, and the channel C may have been encoded with a convolution code rate of, for example, 1/2.

One embodiment of the invention may feed back information from the speech constraint checker 214 to the convolution decoder 202. The feedback information may allow the convolution decoder 202 to modify decoding of the channel A data stream. Other embodiments of the invention may not have the feedback loop from the speech constraint checker 214 to the convolution decoder 202.

The CRC verification block 208 may comprise suitable logic, circuitry, and/or code that may enable verification of channel A data via a 12-bit CRC associated with the channel A. The verification may comprise, for example, use of a constraint algorithm. An exemplary constraint algorithm is explained in more detail with respect to FIGS. 4A, 4B, and 4C.

The decryption block 210 may comprise suitable logic, circuitry, and/or code that may enable decryption of data from the CRC verification block 208 and the convolution decoders 204 and 206. The decryption may comprise, for example, exclusive-ORing the data with a decryption key. The decryption key may be, for example, the same as the encryption key that may have been used to encrypt data to be transmitted by exclusive-ORing the data to be transmitted with the encryption key.

The channel combiner block 212 may comprise suitable logic, circuitry, and/or code that may enable combining of the three channels A, B, and C to a single channel that may comprise, for example, encoded speech data. The speech constraint checker 214 may comprise suitable logic, circuitry, and/or code that may enable testing speech data for compliance with speech constraints. For example, some speech constraints may comprise gain continuity and smoothness in inter-frames or intra-frames, pitch continuity in voice inter-frames or intra-frames, and/or consistency of line spectral frequency (LSF) parameters that are utilized to represent a spectral envelope.

The AMR voice decoder block 216 may comprise suitable logic, circuitry, and/or code that may enable decoding of the encoded speech data from the channel combiner block 212. The output of the AMR voice decoder block 216 may be digital speech data that may be converted to an analog signal. The analog signal may be played as audio sound via a speaker.

The decoding function of the AMR voice decoder block 216 may receive a variable number of bits for decoding. The number of bits may vary depending on the transmission rate chosen by a base station. The receiver 100 may communicate with one or more base stations (not shown), and the base stations may communicate the transmit rate to the receiver 100. Table 1 below may list the various transmission rates.

TABLE 1

| AMR coded Tx rate (Kbps) | Total # of bits | CH A | CH B | CH C |
|---|---|---|---|---|
| 4.75 | 95 | 42 | 53 | 0 |
| 5.15 | 103 | 49 | 54 | 0 |
| 5.9 | 118 | 55 | 63 | 0 |
| 6.7 | 134 | 58 | 76 | 0 |
| 7.4 | 148 | 61 | 87 | 0 |
| 7.95 | 159 | 75 | 84 | 0 |
| 10.2 | 204 | 65 | 99 | 40 |
| 12.2 | 244 | 81 | 103 | 60 |

For each transmission rate, a total number of bits transmitted and number of bits for each channel may be different. For example, a transmission rate of 4.75 Kbps may transmit 95 data bits per frame. Of the 95 data bits, 42 bits may be in channel A stream and 53 bits may be in channel B stream. There may not be any bits allocated to the channel C stream. With the 12.2 Kbps transmission rate, 244 bits may be transmitted per frame. 81 bits may be in channel A stream, 103 bits may be in channel B stream, and 60 bits may be in channel C stream. Channel A may have a 12 bit CRC attached to the data, while channels B and C may not have CRC. The convolution coding rate for channels A and B may be 1/3 and the convolution coding rate for channel C may be 1/2.

In operation, the convolution decoders 202, 204, and 206 may receive channels A, B, and C, respectively, of received speech data. Each convolution decoder may decode the respective channel A, B, or C and output a bit stream. The bit streams output by the convolution decoder 202 may be communicated to the CRC verification block 208. The CRC verification block 208 may verify that a CRC that may be part of the channel A data may be a valid CRC. The validated channel A data, which may have the CRC removed, may be communicated to the decryption block 210. The bit streams output by the convolution decoders 204 and 206 may also be communicated to the decryption block 210. The decryption block 210 may exclusive-OR the data in the bit stream with a decryption key to decrypt the data. The decrypted data for channel A, channel B, and channel C may be communicated to the channel combiner block 212.

The CRC verification block 208 may verify that the CRC that may be part of the channel A data may be a valid CRC. The validated channel A data, which may have the CRC removed, may be communicated to the channel combiner block 212. If the channel A CRC is not valid, the data from channel A, and the channel B data and the channel C data associated with the invalid channel A data may not be used. Additionally, a bad frame indicator (BFI) flag may be asserted to indicate to, for example, the AMR voice decoder block 216 that the current speech frame may not be valid.

If the CRC for channel A is valid, the channel combiner block 212 may combine the data for the three channels to form a single bit stream that may be communicated to the speech constraint checker 214. The speech constraint checker 214 may verify that the bit stream may meet speech constraints. A bit stream may be communicated from the speech constraint checker 214 to the AMR voice decoder block 216. The speech constraint checker 214 may also communicate a BFI flag to the AMR voice decoder block 216. If the BFI flag is unasserted, the AMR voice decoder block 216 may decode the bit stream to digital data that may be converted to an analog voice signal. If the BFI flag is asserted, the bit stream may be ignored.

In an embodiment of the invention, the speech constraint checker 214 may communicate a feedback signal to the convolution decoder 202. The feedback signal may be, for example, an estimated value of a current speech parameter that may be fed back to the convolution decoder 202, which may be, for example, the modified Viterbi decoder. Other embodiments of the invention may not have a feedback loop from the speech constraint checker 214 to the convolution decoder 202.

Figure 2B:
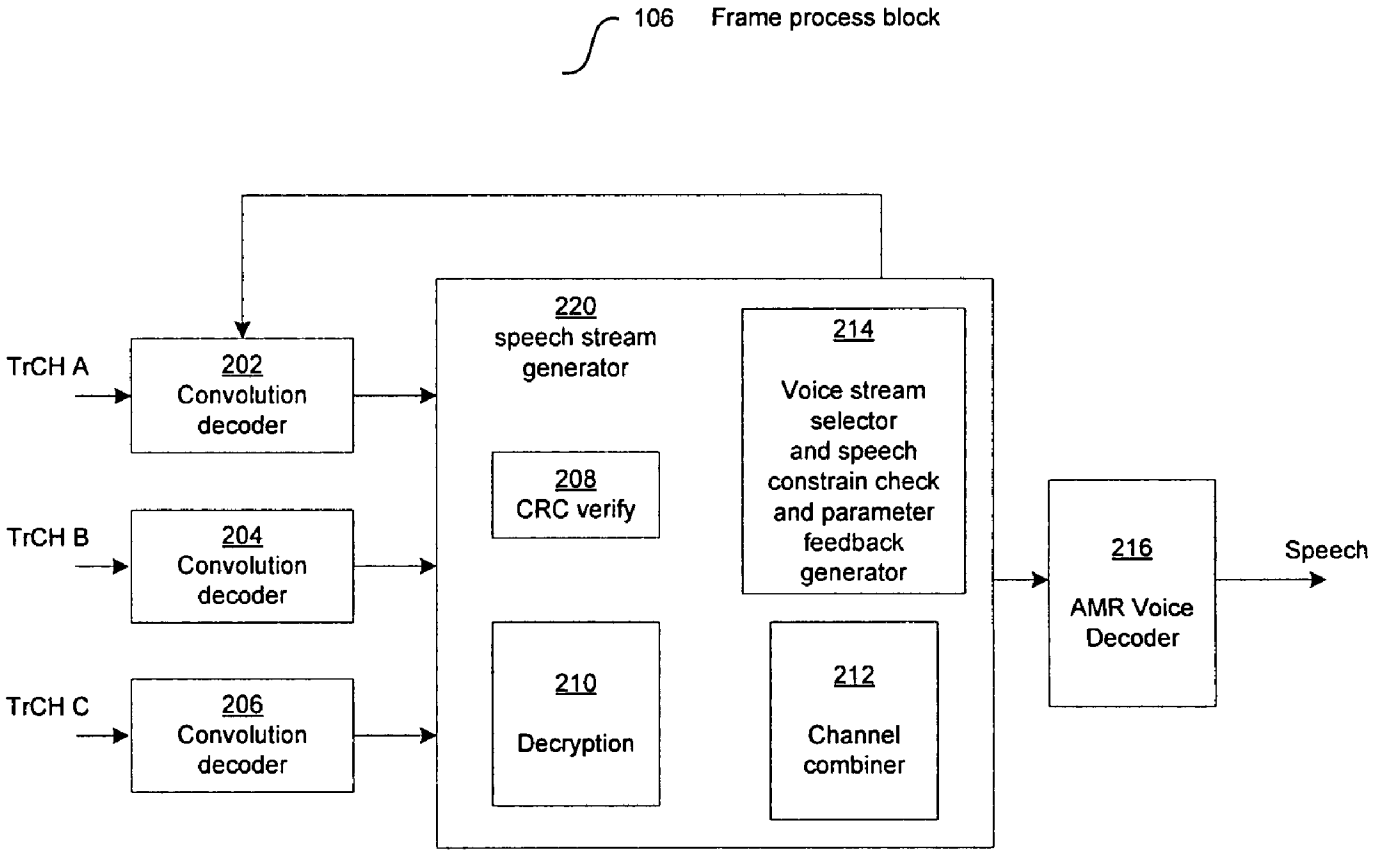
FIG. 2B is a block diagram illustrating a frame process block shown in FIG. 1A, in accordance with an embodiment of the invention.

FIG. 2B is a block diagram illustrating a frame process block shown in FIG. 1A, in accordance with an embodiment of the invention. Referring to FIG. 2B, there is shown the convolution decoder blocks 202, 204, and 206, which may be modified Viterbi decoders, the AMR voice decoder block 216, and a speech stream generator block 220. The speech stream generator block 220 may comprise the CRC verification block 208, the decryption block 210, the channel combiner block 212, and a speech constraint checker/speech stream selector block 218.

The speech constraint checker/speech stream selector block 218 may comprise suitable logic, circuitry, and/or code that may enable selection of a bit stream from a plurality of candidate bit streams. The speech constraint checker/speech stream selector block 214 may also enable estimation of a value of a current speech parameter where encoded bits may be fed back to the convolution decoder 202, which may be, for example, the modified Viterbi decoder. However, the invention need not be so limited. For example, some embodiments of the invention may not have a feedback loop from the speech constraint checker/speech stream selector block 214 to the convolution decoder 202. The speech constraint checker/speech stream selector block 218 may base the selection on constraints for speech. For example, one constraint may be an amount of change allowed in volume, or gain, from one voice sample to the next. Another example of a constraint may be an amount of voice pitch change from one voice sample to the next. Accordingly, the speech stream selector block 218 may output a single bit stream selected from one or more candidate bit streams.

In operation, the decoded bit streams from the convolution decoder blocks 202, 204, and 206 may be communicated to the speech stream generator block 220. The speech stream generator block 220 may decrypt the data in the speech streams and verify that the CRC is valid for channel A data. The channel combiner block 220 may also combine data in each of the plurality of bit streams for channels A, B, and C to generate a plurality of bit streams. The speech constraint checker/speech stream selector block 218 may select a bit stream that may satisfy the speech constraints. The process of selecting a bit stream may be described in more detail with respect to FIGS. 4A, 4B, 4C, 5A, 5B, 5C, 6, 7A, and 7B.

Although the speech stream generator block 220 may have been described as hardware blocks with specific functionality, the invention need not be so limited. For example, other embodiments of the invention may use a processor, for example, the processor 112, for some or all of the functionality of the speech generator block 220.

Figure 3:
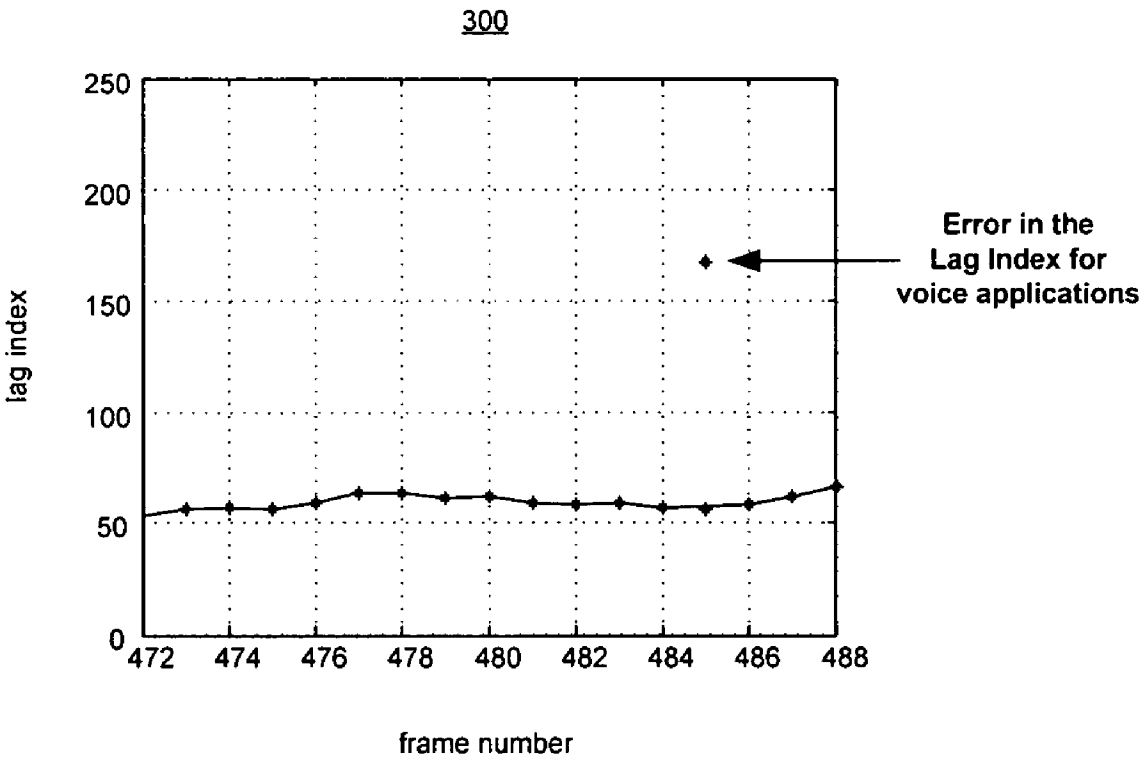
FIG. 3 is a diagram illustrating irregularity in pitch continuity voice frames, which may be utilized in association with an embodiment of the invention.

FIG. 3 is a diagram illustrating irregularity in pitch continuity in voice frames, which may be utilized in association with an embodiment of the invention. Referring to FIG. 3, there is shown a graph 300 of a lag index or pitch continuity as a function of frame number with a non-physical pitch in frame 485 due to bit error. In instances where the lag index may comprise a continuity that results from physical constraints in speech, applying a physical constraint to the decoding operation of the lag index may reduce decoding errors.

For certain data formats, the inherent redundancy of the physical constraints may result from, for example, the packaging of the data and the generation of a redundancy verification parameter, such as a cyclic redundancy check (CRC), for the packetized data. In voice transmission applications, such as AMR in WCDMA, the physical constraints may be similar to those utilized in general speech applications. Physical constraints may comprise gain continuity and smoothness in inter-frames or intra-frames, pitch continuity in voice inter-frames or intra-frames, continuity of line spectral frequency (LSF) parameters and format locations that are utilized to represent speech. Moreover, WCDMA speech application may utilize redundancy, such as with CRC, as a physical constraint. For example, WCDMA application with adaptive multi-rate (AMR) coding may utilize 12 bits for CRC.

Regarding the frame process operation of the decoder 100, another approach for decoding convolutional encoded data may be to utilize a maximum a posteriori probability (MAP) algorithm. This approach may utilize a priori statistics of the source bits such that a one-dimensional a priori probability, $p(b_i)$, may be generated, where $b_i$ corresponds to a current bit in the bit-sequence to be encoded. To determine the MAP sequence, the Viterbi transition matrix calculation may need to be modified. This approach may be difficult to implement in instances where the physical constraints are complicated and when the correlation between bits $b_i$ and $b_j$, where i and j are far apart, may not be easily determined. In cases where a parameter domain has a high correlation, the MAP algorithm may be difficult to implement. Moreover, the MAP algorithm may not be utilized in cases where inherent redundancy, such as for CRC, is part of the physical constraints.

The maximum-likelihood sequence estimate (MLSE) for a bit-sequence may be a preferred approach for decoding convolutional encoded data. A general solution for the maximum of the conditional probability $P(X|R)$, where R meets a certain set of physical constraints $C(X)$, for the MLSE may still be difficult to implement. In this regard, an efficient solution may require a suboptimal solution that takes into consideration complexity and implementation of the physical constraints. The following example illustrates the application of a solution that efficiently implements physical constraints into the decoding of voice data.

Figure 4A:
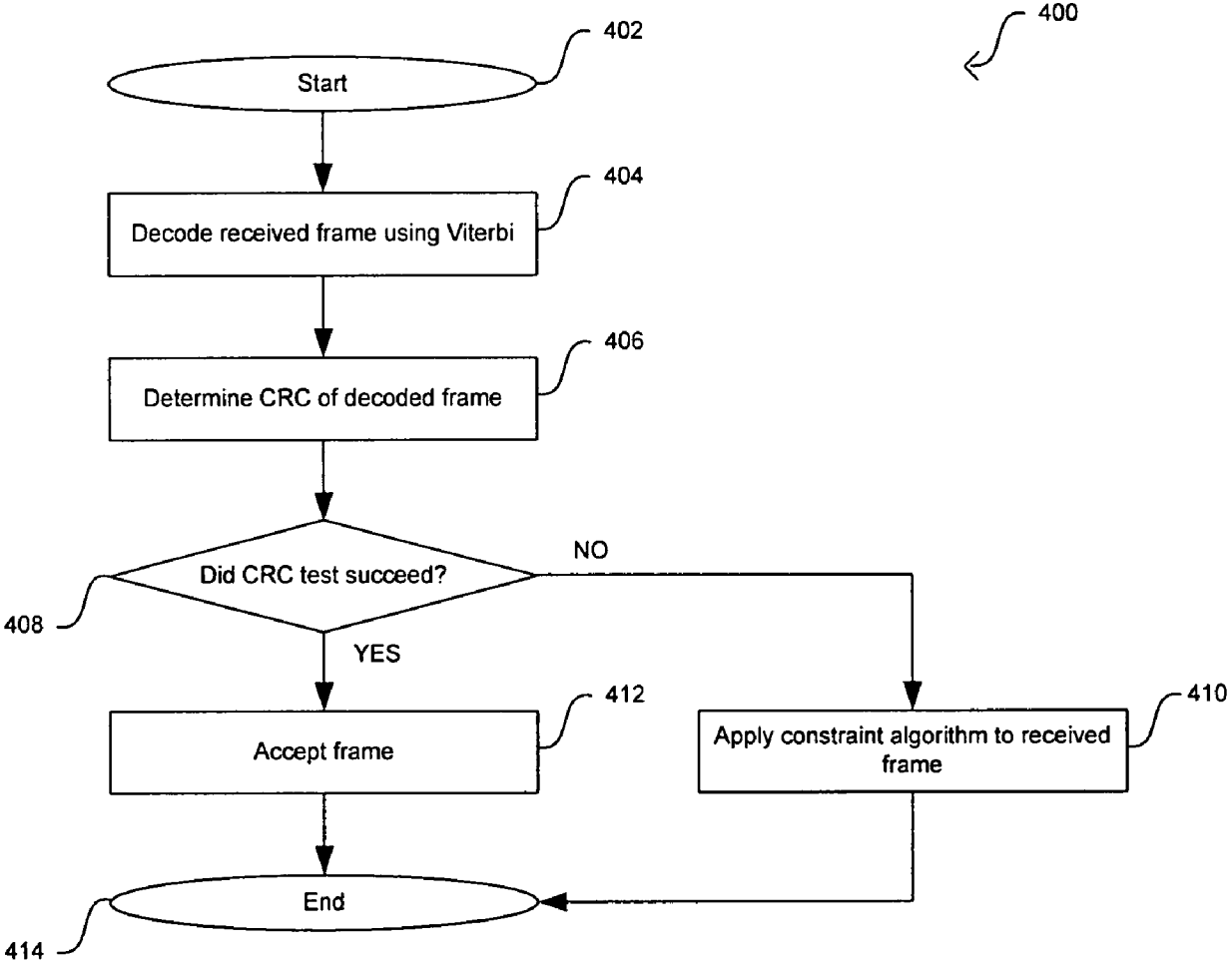
FIG. 4A is a flow diagram illustrating exemplary steps in the application of redundancy to a multilayer process, in accordance with an embodiment of the invention.

FIG. 4A is a flow diagram illustrating exemplary steps in the application of redundancy process, in accordance with an embodiment of the invention. Redundancy may refer to information in the data being decoded that may help to decode data. An exemplary redundancy may be a CRC associated with data. Accordingly, the CRC may be used to determine valid data. For data with corrupted bits, the redundancy of the CRC may be used to generate likely sequences of bits. Since WCDMA may only use CRC for channel A, FIG. 4A may be relevant to channel A. Referring to FIG. 4A, after start step 402, in step 404, the receiver 100 in FIG. 1A may decode a received channel A frame in the frame process block 106 by utilizing the Viterbi algorithm. In step 406, a redundancy verification parameter, for example, the CRC, may be determined for the decoded channel A frame. In step 408, the receiver 100 may determine whether the CRC verification test was successful. When the CRC verifies the decoded channel A frame, the receiver 100 may proceed to step 412 where the decoded channel A frame is accepted. After step 412, the receiver 100 may proceed to end step 414.

Returning to step 408, when the CRC verification test is not successful for the decoded channel A frame, the receiver 100 may proceed to step 410. In step 410, the receiver 100 may perform a redundancy algorithm that may be utilized to provide a decoding performance that may result in equal or reduced decoding errors than those that may occur from utilizing the standard Viterbi algorithm. The redundancy algorithm of step 410 may result in a modified Viterbi algorithm generating one or more candidate bit-sequences based on the redundancy used, for example, the CRC and/or speech continuity tests. If no candidate bit-sequence can be generated, the data may be rejected as being a bad frame. Accordingly, the data in that frame may not be used further. The step 410 may be described in more detail with respect to FIGS. 4B and 4C. After step 410, the receiver 100 may proceed to end step 414.

Speech constraints may be used to select a bit-sequence from the candidate bit-sequences. The selected bit-sequence may be decoded by, for example, the AMR voice decoder block 216. In this regard, a set of k bit-sequences {S1, S2, . . . , Sk} may be determined from the MLSE that meet the CRC constraint. Once the set of k sequences is determined, a best sequence, Sb, may be determined that also meets the WCDMA voice or speech constraints.

Figure 4B:
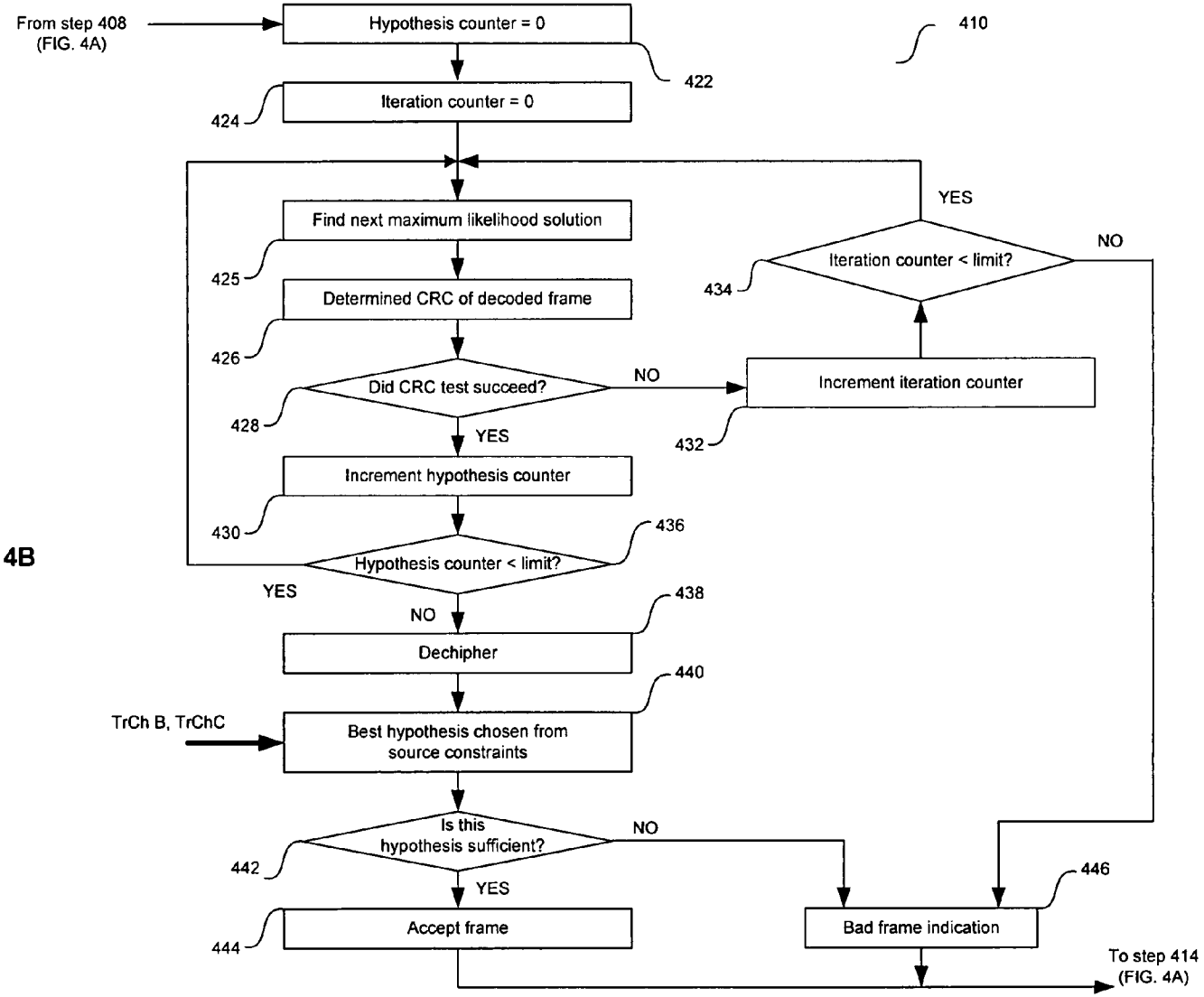
FIG. 4B is a flow diagram illustrating exemplary steps in the application of a constraint algorithm to a received frame, in accordance with an embodiment of the invention.

FIG. 4B is a flow diagram illustrating exemplary steps in the application of a constraint algorithm to a received frame, in accordance with an embodiment of the invention. Referring to FIG. 4B, when the CRC verification test is not successful for the decoded channel A frame in step 408 in FIG. 4A, the receiver 100 in FIG. 1A may proceed to step 422. In step 422, a hypothesis counter may be set to an initial counter value, for example, zero. The hypothesis may refer to a candidate bit-sequence that may be a likely solution. Since the CRC failed in step 408, other bit-sequences may have to be generated from the bit-sequence that failed the CRC in step 408. The generated bit-sequences that pass the CRC may be referred to as hypotheses. In step 424, an iteration counter may be set to an initial counter value, for example, zero. The iteration counter may keep track of the number of bit-sequences that may have been generated and tested as a hypothesis. Accordingly, the iteration counter may be used to limit the number of bit-sequences that are generated.

In step 425, the next maximal likelihood solution may be generated. This may be a bit-sequence with the next best metric, or the next highest probability of being the correct bit-sequence. This may be generated by using, for example, a modified Viterbi algorithm. In step 426, the CRC of the decoded channel A frame may be determined. In step 428, the receiver 100 may verify whether the CRC generated for the present bit-sequence may be equal to the received CRC. If the CRC verification test is not successful, the operation may proceed to step 432. In step 432, the iteration counter may be incremented. In step 434, the receiver 100 may determine whether the iteration counter is less than a predetermined limit. If the iteration counter has a value greater than or equal to a predetermined limit, the operation may proceed to step 446 where a bad frame indication is generated. Otherwise, the next step may be step 425 where a next maximum likelihood solution may be determined.

Returning to step 428, if the CRC verification test is successful, the operation may proceed to step 430. In step 430, the hypothesis counter may be incremented. After step 430, in step 436, the receiver 100 may determine whether the hypothesis counter is less than a predetermined limit. If the hypothesis counter is lower than the predetermined limit, the operation may proceed to step 425 where the next maximum likelihood solution may be determined. If the hypothesis counter is equal to the predetermined limit, the operation may proceed to step 438 where the hypotheses may be decrypted. In step 440, the best hypothesis may be chosen from the decrypted hypotheses by using the WCDMA AMR source constraints. The best hypothesis may be found by, for example, applying physical constraint test to a hypothesis, which may apply to channel A, combined with the decoded bits of channel B and channel C.

Some characteristic physical constraint tests that may be utilized by, for example, adaptive multi-rate (AMR) coding are line spectral frequency (LSF) parameters, gain continuity, and/or pitch continuity. For the LSF parameters, some of the tests may be based on the distance between two formants, changes in consecutive LSF frames or sub-frames, and the effect of channel metrics on the thresholds. For example, the smaller the channel metric, the more difficult it is to meet the threshold. Regarding the use of gain as a physical constraint test, the criteria may be smoothness or consistency between consecutive frames or sub-frames. Regarding pitch, the criteria may be the difference in pitch between frames or sub frames.

After step 440, in step 442, the receiver 100 may determine whether the best hypothesis chosen in step 440 is sufficient to accept the decoded channel A frame. When the chosen hypothesis is sufficient to accept the decoded channel A frame, the operation may proceed to step 444 where the decoded channel A frame may be accepted. When the chosen hypothesis is not sufficient to accept the decoded channel A frame, the operation may proceed to step 446 where a bad frame indication is generated. After step 444 or step 446, the operation may proceed to end step 414 in FIG. 4A.

Figure 4C:
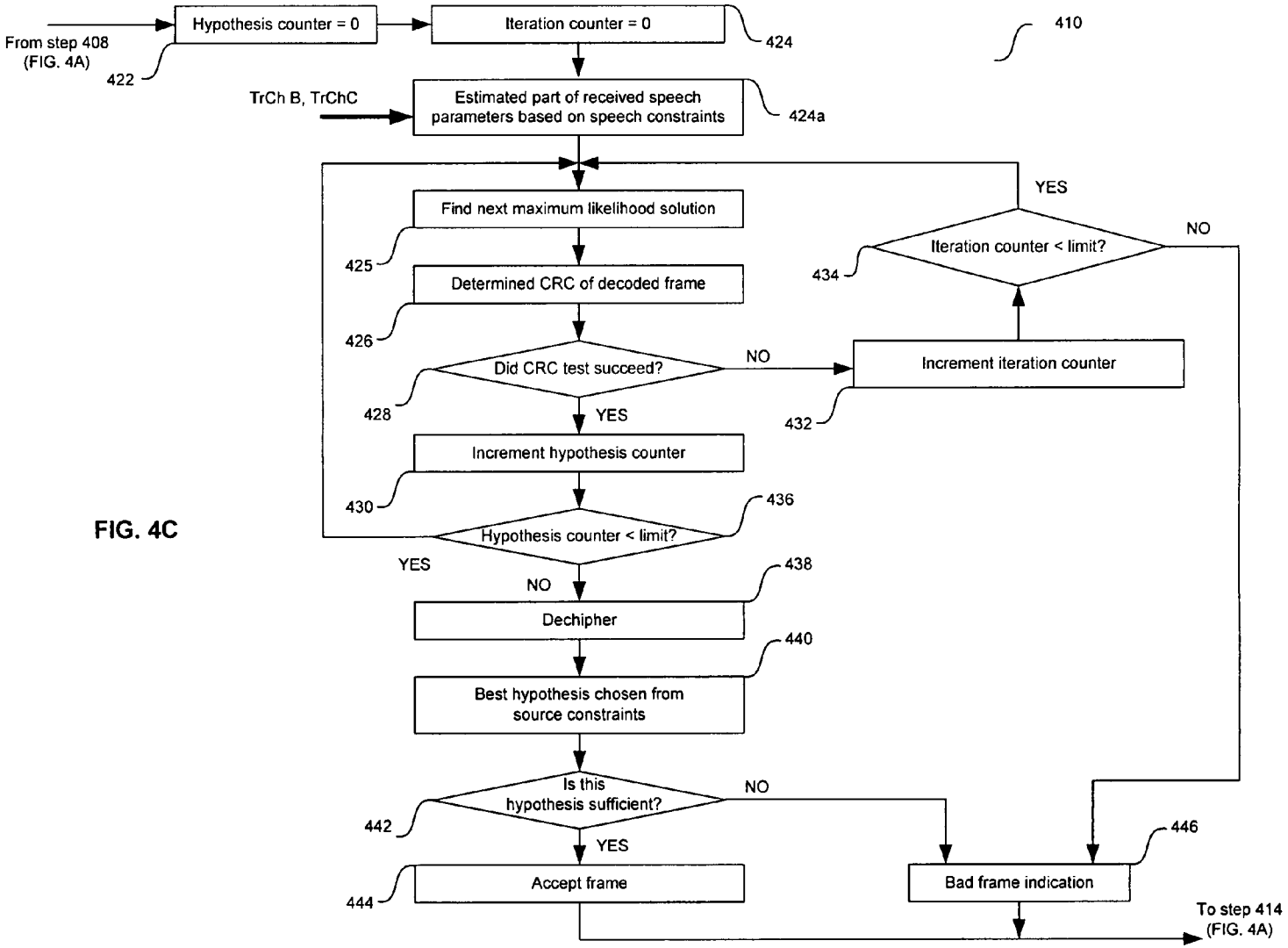
FIG. 4C is a flow diagram illustrating exemplary steps in the application of a constraint algorithm to a received frame, in accordance with an embodiment of the invention.

FIG. 4C is a flow diagram illustrating exemplary steps in the application of a constraint algorithm to a received frame, in accordance with an embodiment of the invention. Steps of FIG. 4C may be similar to the steps of FIG. 4B, except that the step 424 may lead to step 424*a* in FIG. 4C rather than step 425 as in FIG. 4B. Referring to FIG. 4C, when the CRC verification test is not successful for the decoded channel A frame in step 408 in FIG. 4A, the receiver 100 in FIG. 1A may proceed to step 422. In step 422, a hypothesis counter may be set to an initial counter value, for example, zero. The hypothesis may refer to a candidate bit-sequence that may be a likely solution. Since the CRC failed in step 408, other bit-sequences may have to be generated from the bit-sequence that failed the CRC in step 408. The generated bit-sequences that pass the CRC may be referred to as hypotheses. In step 424, an iteration counter may be set to an initial counter value, for example, zero. The iteration counter may keep track of the number of bit-sequences that may have been generated and tested as a hypothesis. Accordingly, the iteration counter may be used to limit the number of bit-sequences that are generated.

In step 424*a*, the decoded bits of channel B and channel C may be estimated as speech data based on speech constraints. Accordingly, the maximum likelihood solutions for channel A may be generated by taking in to account the data streams from channels B and C. Some characteristic speech constraint tests that may be utilized are line spectral frequency (LSF) parameters, gain continuity, and/or pitch continuity. For the LSF parameters, some of the tests may be based on the distance between two formants, changes in consecutive LSF frames or sub-frames, and the effect of channel metrics on the thresholds. For example, the smaller the channel metric, the more difficult it is to meet the threshold. Regarding the use of gain as a physical constraint test, the criteria may be smoothness or consistency between consecutive frames or sub-frames. Regarding pitch, the criteria may be the difference in pitch between frames or sub frames.

In step 425, the next maximal likelihood solution may be generated taking in to account the bit streams of channels B and C. This may be a bit-sequence with the next best metric, or the next highest probability of being the correct bit-sequence. This may be generated by using, for example, a modified Viterbi algorithm. In step 426, the CRC of the decoded channel A frame may be determined. In step 428, the receiver 100 may verify whether the CRC generated for the present bit-sequence may be equal to the received CRC. If the CRC verification test is not successful, the operation may proceed to step 432. In step 432, the iteration counter may be incremented. In step 434, the receiver 100 may determine whether the iteration counter is less than a predetermined limit. If the iteration counter has a value greater than or equal to a predetermined limit, the operation may proceed to step 446 where a bad frame indication is generated. Otherwise, the next step may be step 425 where a next maximum likelihood solution may be determined.

Returning to step 428, if the CRC verification test is successful, the operation may proceed to step 430. In step 430, the hypothesis counter may be incremented. After step 430, in step 436, the receiver 100 may determine whether the hypothesis counter is less than a predetermined limit. If the hypothesis counter is lower than the predetermined limit, the operation may proceed to step 425 where the next maximum likelihood solution may be determined. If the hypothesis counter is equal to the predetermined limit, the operation may proceed to step 438 where the hypotheses may be decrypted. In step 440, the best hypothesis may be chosen from the decrypted hypotheses by using the WCDMA AMR source constraints. The best hypothesis may be found by, for example, applying a physical constraint test to a hypothesis.

Some characteristic physical constraint tests that may be utilized by, for example, adaptive multi-rate (AMR) coding are line spectral frequency (LSF) parameters, gain continuity, and/or pitch continuity. For the LSF parameters, some of the tests may be based on the distance between:two formants, changes in consecutive LSF frames or sub-frames, and the effect of channel metrics on the thresholds. For example, the smaller the channel metric, the more difficult it is to meet the threshold. Regarding the use of gain as a physical constraint test, the criteria may be smoothness or consistency between consecutive frames or sub-frames. Regarding pitch, the criteria may be the difference in pitch between frames or sub frames.

After step 440, in step 442, the receiver 100 may determine whether the best hypothesis chosen in step 440 is sufficient to accept the decoded channel A frame. When the chosen hypothesis is sufficient to accept the decoded channel A frame, the operation may proceed to step 444 where the decoded channel A frame may be accepted. The accepted frame may be combined with channel B and channel C data. When the chosen hypothesis is not sufficient to accept the decoded channel A frame, the operation may proceed to step 446 where a bad frame indication is generated. After step 444 or step 446, the operation may proceed to end step 414 in FIG. 4A.

Figure 5A:
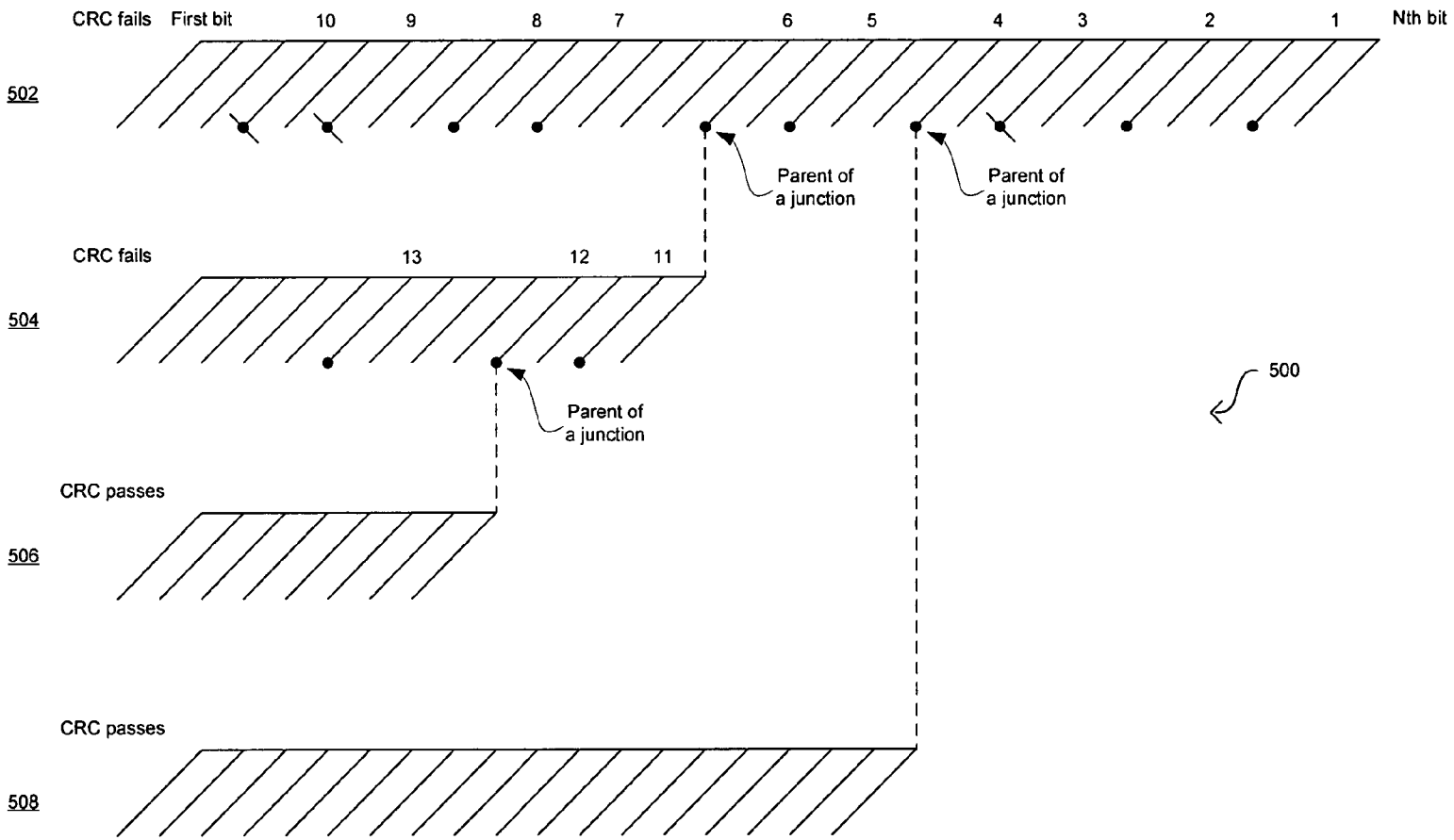
FIG. 5A is diagram illustrating an exemplary search process for a hypothesis that meets CRC constraint, in accordance with an embodiment of the invention.

FIG. 5A is diagram illustrating an exemplary search process for a hypothesis that meets CRC constraint, in accordance with an embodiment of the invention. Referring to FIG. 5A, there is shown the search tree 500 with four bit-sequences 502, 504, 506, and 508. The search tree 500 may correspond to an exemplary sequence search process that may start with the reduced set of estimated bit-sequences generated by a Viterbi operation. In this regard, the bit-sequence 502 may correspond to a bit-sequence that may result from, for example, the standard Viterbi operation. The bit-sequence 502 is a sequence of bits that has the highest metric according to the Viterbi algorithm. The bit-sequence metrics may be obtained during operation of the Viterbi algorithm. Each of the junctions, which may be a bit, for example, is shown as a diagonal line and corresponds to an estimated bit probability from the Viterbi operation.

If the bit-sequence 502 does not meet the CRC constraint, then the algorithm may generate other bit-sequences from the bit-sequence 502. The other bit-sequences may be generated by identifying the most likely junctions to use. The most likely junctions may be those bits that have the smallest probabilities of being the logic states assigned to that branch. Accordingly, the junctions identified may be those bits that may have a probability of being a logic 0 closest to a probability of being a logic 1. Other bit-sequences may be generated from a junction that is a logic 0 and is changed to logic 1, or vice versa. The selection of junctions may depend on a metric parameter of the source, where the metric parameter may, in some instances, comprise a channel metric portion and a physical constraint metric portion.

As shown, 10 junctions may be identified. The junctions identified are shown with a small dark circle at the end of each diagonal line. Junction 6 may be chosen for the next bit-sequence since it may have a higher junction metric than the other 9 junctions. In other words, the junction 6 may have the smallest probability of being the logic state it is at as compared to the other bits, including the other 9 junctions. Accordingly, the junction 6 may be considered to be the most likely candidate to change its logic state. Based on changing the state of the junction 6, the bit-sequence 504 may be generated. A new bit-sequence of N bits may be generated by concatenating the bits from the first bit of the bit-sequence 502 up to the junction 6 to the bit-sequence generated from the junction 6. This bit-sequence may be the next maximal likelihood solution. A trace back pointer may be generated to be able to sequence the bits in the bit-sequence 502 with the bits in the bit-sequence 504. A CRC of this new bit-sequence may be calculated. If this new bit-sequence generated using junction 6 also fails the CRC constraint, then other bit-sequences may need to be generated from junctions in the bit-sequence 502 and/or 504.

The bit-sequence 504 may be searched for junctions that may have higher junction metrics than any of the remaining 9 junctions identified in the bit-sequence 502. For example, junctions 11, 12 and 13 may be identified from the bit-sequence 504. These junctions may replace, for example, the junctions 3, 9, and 10 since the junctions 3, 9, and 10 may have lower junction metrics than the junctions 11, 12, and 13. This is shown by a small dash across the dark circle at the end of the diagonal line.

As shown, the CRC fails for the new bit-sequence that includes the bit-sequence 504. Therefore, a new bit-sequence may be created from one of the remaining junctions with the highest metric, for example, junction 12 as shown. In this instance, the bit-sequence 506 that results from junction 12 meets the CRC constraint and the search process may return to the top row and to the junction with the next highest metric. The estimated bit-sequence associated with junction 12 may be selected as one of the bit-sequences for the set of k sequences {S1, S2, . . . , Sk}.

As shown, junction 4 represents the next highest metric after junction 6 in the set of junctions and a new bit-sequence may be created from junction 4. In this instance, a new bit-sequence that comprises the portion of the bit-sequence 502 from the first bit to the junction 4 and the bit-sequence 508 meets the CRC constraint. Accordingly, the bit-sequence associated with junction. 4 may be selected as one of the bit-sequences for the set of k sequences {S1, S2, . . . , Sk}. This approach may be followed until the limit of k sequences is exceeded or the search from all the remaining selected junctions is performed. In this regard, a plurality of trace back pointers may be calculated during the search operation. The size of the set of k sequences {S1, S2, . . . , Sk} may vary according to design and/or implementation.

Figure 5B:
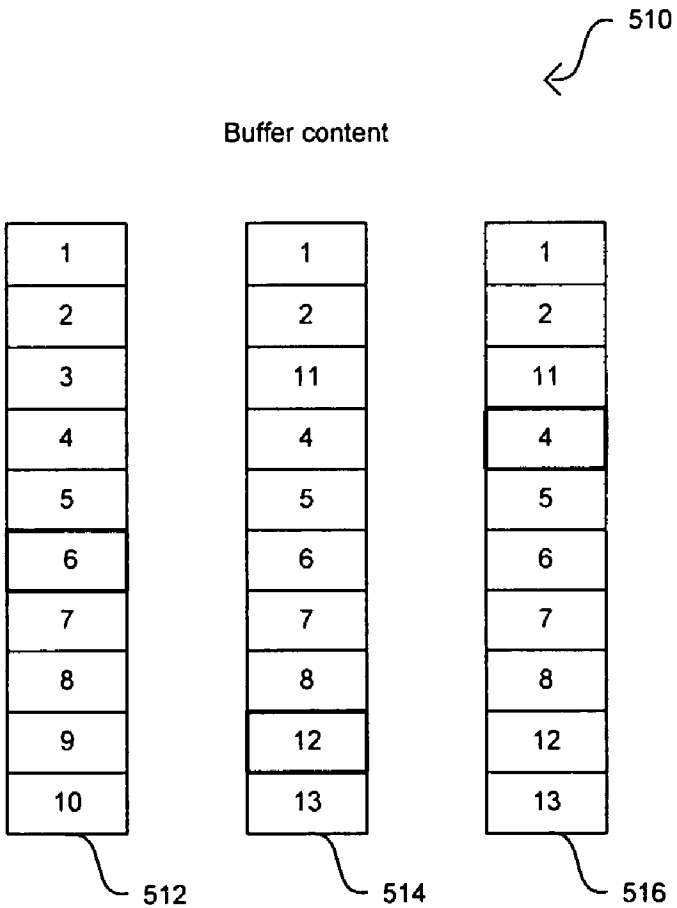
FIG. 5B is a diagram illustrating exemplary buffer content during the search process described in FIG. 5A, in accordance with an embodiment of the invention.

FIG. 5B is a diagram illustrating exemplary buffer content during the search process described in FIG. 5A, in accordance with an embodiment of the invention. Referring to FIG. 5B, there is shown a buffer content 510 that may correspond to the junctions under consideration during the search process. For example, state 512 may correspond to the initial 10 junctions in the search operation. In this regard, junction 6 is highlighted to indicate that it corresponds to the highest junction metric value and is the starting point of a bit-sequence. Step 514 may correspond to the next set of 10 junctions. In this instance, junctions 3, 9, and 10 have been replaced with junctions 11, 12, and 13 that resulted from the bit-sequence 504 created from junction 6. Junction 12 is highlighted to indicate that is corresponds to the highest metric value and is the starting point of the bit-sequence 506. State 516 may correspond to the next set of 10 junctions. In this instance, junction 4 is highlighted to indicate that it corresponds to the highest metric value and is the starting point of the bit-sequence 508. Trace back pointers may be calculated at each state to track the search process.

Figure 5C:
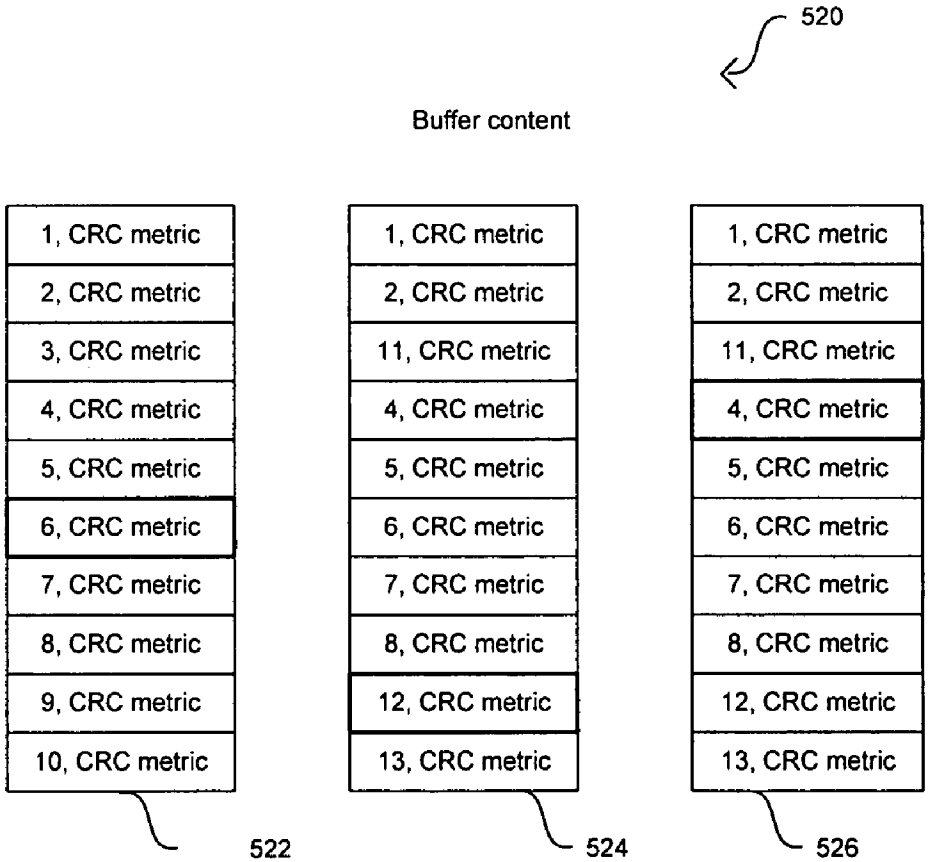
FIG. 5C is a diagram illustrating exemplary buffer content when CRC and trace back pointers are calculated simultaneously during the search process described in FIG. 5A, in accordance with an embodiment of the invention.

FIG. 5C is a diagram illustrating exemplary buffer content when CRC and trace back pointers are calculated simultaneously during the search process described in FIG. 5A, in accordance with an embodiment of the invention. Referring to FIG. 5C, there is shown a buffer content 520 that may correspond to the junction labels under consideration during the search process and the corresponding CRC calculations. As with FIG. 5B, the buffer content 520 may vary its contents based on a current state. For state 522, state 524, and state 526, the contents that correspond to the current junctions under consideration are the same as in state 512, state 514, and state 516 in FIG. 5B respectively. However, in order to simplify the search process for hypothesis, the CRC and the trace back pointers for the states may be calculated simultaneously. This approach is possible because the CRC may be calculated as sum($b_iR_i$), where $R_i$ is the remainder of xi/g(x), g(x) is the generator polynomial of the CRC, and $b_i$ is the value of the bit i. The CRC metric of each sequence may be kept or stored in the buffer content 520. The CRC metric may be obtained as the sum of the biRi values from the junction to the last bit, and may also be determined as the sum of the parent sequence CRC metric and sum of the biRi values from junction to its parent. The sequence may meet the CRC condition if the CRC metric is equal to the sum of the biRi values from first bit to the junction. The values for $R_i$ may be stored in, for example, a look up table.

Once the set of k sequences {S1, S2, . . . , Sk} has been determined by following the search process as described in FIGS. 5A-5C, the redundancy algorithm may require that the receiver 100 in FIG. 1A selects one of the bit-sequences as the best bit-sequence, Sb, where Sb corresponds to the bit-sequence that meets the CRC constraint and the physical constraints with the highest level of confidentiality. The best bit-sequence may also be referred to as the decoded output bit-sequence of the process.

For each of the candidate bit-sequences in the set of k sequences {S1, S2, . . . , Sk}, a set of T1 different physical constraint tests, {Test(j), . . . , Test(T1)}, may be performed. The physical constraint tests correspond to tests of quantifiable characteristics of the type of data received for a particular application. The scores of the physical constraint tests for an $i^{th}$ bit-sequence, {T_SC(i, j), . . . , T_SC(i, T1)}, may be utilized to determine whether the bit-sequence passed or failed a particular test. For example, when T_SC(i, j)>0, the $i^{th}$ bit-sequence is said to have failed the $j^{th}$ physical constraint test. When the T_SC(i, j)<=0, the $i^{th}$ bit-sequence is said to have passed the $j^{th}$ physical constraint test. In some instances, when the value of a test score is smaller, the reliability of the score may be increased.

Once the physical constraint tests are applied to the candidate estimated bit-sequences, the following exemplary approach may be followed: when a score is positive, the candidate bit-sequence may be rejected; for a particular physical constraint test, the candidate with the best score or with the lowest score value may be found; the candidate that is selected as the best score for the most number of tests may be selected as the best bit-sequence, Sb.

Table 2 illustrates an exemplary embodiment of the invention in which a set of five candidate bit-sequences, {S1, S2, S3, S4, and S5}, may be tested using a set of four physical constraint tests, {Test(1), Test(2), Test(3), and Test(4)}. The scores may be tabulated to identify passing and failing of various tests for each of the candidate bit-sequences. In this instance, S2 and S4 are rejected for having positive scores for Test(2) and Test(4) respectively. The bit-sequence S3 is shown to have the lowest score in Test(1), Test(3), and Test(4) and may be selected as the best bit-sequence, Sb.

TABLE 2

| Candidate | Test (1) | Test (2) | Test (3) | Test (4) |
|---|---|---|---|---|
| S1 | Score(1, 1) < 0 | Score(1, 2) < 0 | Score(1, 3) < 0 | Score(1, 4) < 0 |
| S2 | Score(2, 1) < 0 | Score(2, 2) > 0 | Score(2, 3) < 0 | Score(2, 4) < 0 |
| S3 | Score(3, 1) < 0 | Score(3, 2) < 0 | Score(3, 3) < 0 | Score(3, 4) < 0 |
| S4 | Score(4, 1) < 0 | Score(4, 2) < 0 | Score(4, 3) < 0 | Score(4, 4) > 0 |
| S5 | Score(5, 1) < 0 | Score(5, 2) < 0 | Score(5, 3) < 0 | Score(5, 4) < 0 |
| Bit-sequence with minimum score | S3 | S5 | S3 | S3 |

Some characteristic physical constraint tests that may be utilized by, for example, adaptive multi-rate (AMR) coding are line spectral frequency (LSF) parameters, gain continuity, and/or pitch continuity. For the LSF parameters, some of the tests may be based on the distance between two formants, changes in consecutive LSF frames or sub-frames, and the effect of channel metrics on the thresholds. For example, the smaller the channel metric, the more difficult it is to meet the threshold. Regarding the use of gain as a physical constraint test, the criteria may be smoothness or consistency between consecutive frames or sub-frames. Regarding pitch, the criteria may be the difference in pitch between frames or sub frames.

Figure 6:
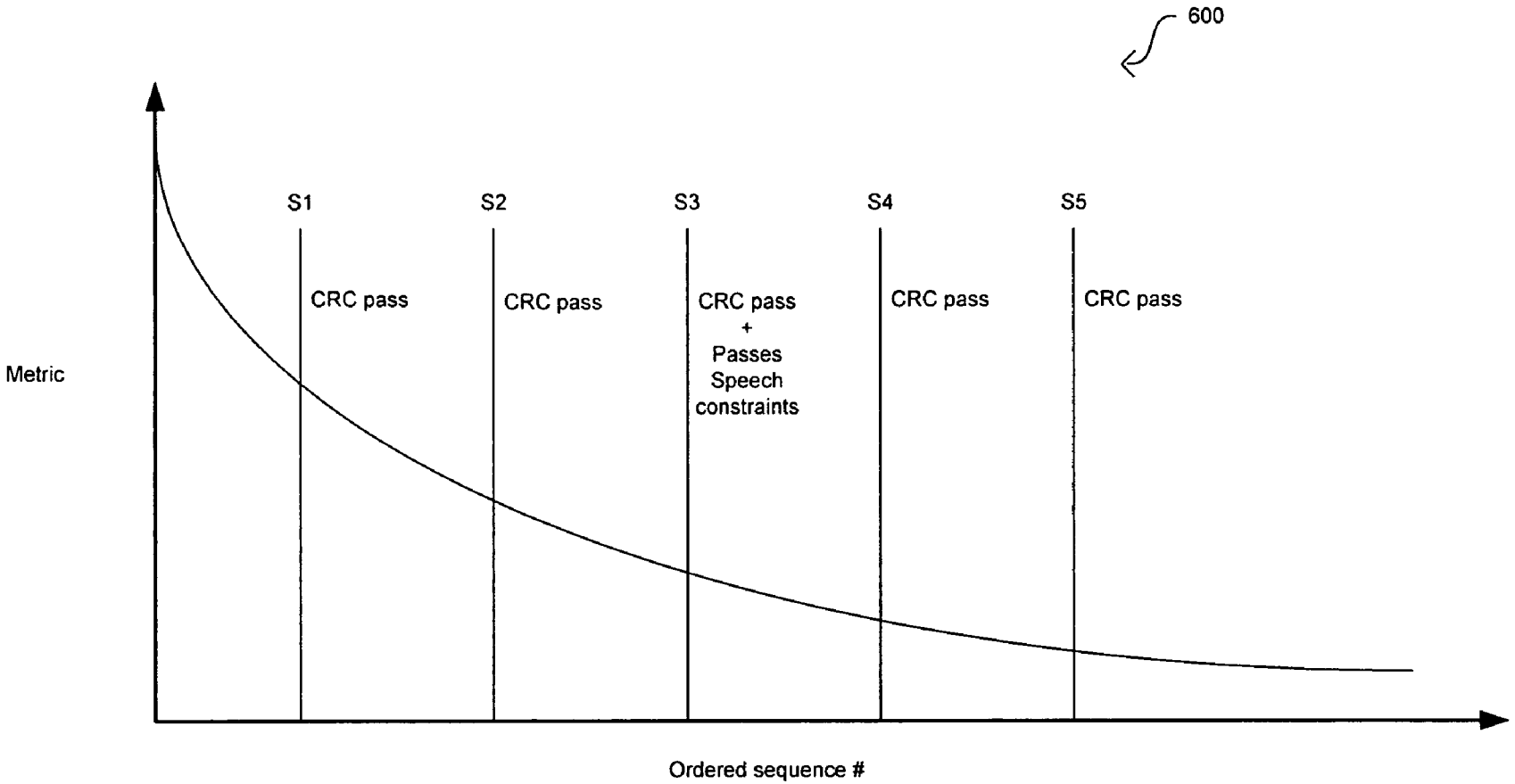
FIG. 6 is a graph illustrating exemplary set of sequences that meets CRC and speech constraints, in accordance with an embodiment of the invention.

FIG. 6 is a graph illustrating exemplary set of sequences that meets CRC and speech constraints, in accordance with an embodiment of the invention. Referring to FIG. 6, there is shown the result of the redundancy algorithm. For example, the search process for T hypothesis as shown in FIGS. 5A-5C may result in the set of bit-sequences {S1, S2, S3, S4, and S5}. These bit-sequences were selected based on their metric values and passing the CRC verification. The set of bit-sequences were also required to pass physical constraint tests as described herein.

The approach described herein may result in fewer decoding bit errors than may occur with the standard Viterbi algorithm. The use of redundancy information may be efficiently implementation in the design of optimized receivers for decoding convolutional encoded data by adding at least one physical constraint to a portion of the results that may be achieved by the Viterbi algorithm.

Figure 7A:
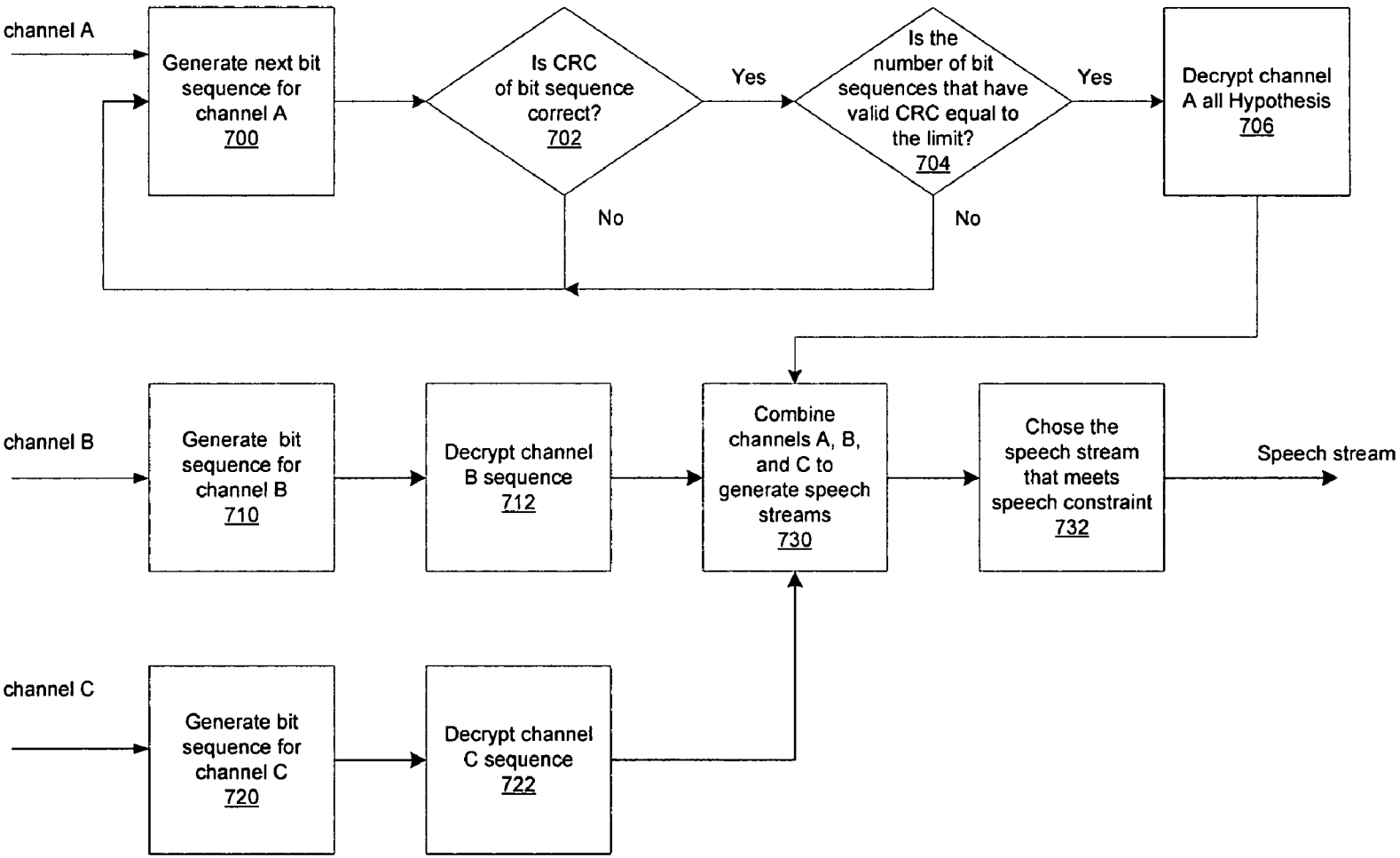
FIG. 7A is a flow chart illustrating exemplary steps for generating a speech stream in a WCDMA receiver, in accordance with an embodiment of the invention.

FIG. 7A is a flow chart illustrating exemplary steps for generating a speech stream in a WCDMA receiver, in accordance with an embodiment of the invention. Referring to FIG. 7A, in step 700, channel A data may be received and a bit-sequence may be generated by, for example, using a modified Viterbi algorithm. In step 702, a CRC may be generated for the bit-sequence and the generated CRC may be compared to the CRC that was transmitted with the channel A data. If the CRCs are not the same, the next step may be step 700 where a new bit-sequence may be generated. If the CRCs are the same, the next step may be step 704.

In step 704, the number of bit-sequences with valid CRCs may be determined to see if it's at a maximum number allowed. If there are less than a maximum number of bit-sequences with valid CRCs, then the next step may be step 700 where a new bit-sequence may be generated. Otherwise, the next step may be step 706. In step 706, the bit-sequence from step 704 may be decrypted by, for example, the decryption block 210. The decryption may comprise, for example, exclusive-ORing the data in the bit-sequence with a decryption key. The decryption key may be, for example, the same as the encryption key that may have been used to encrypt data to be transmitted by exclusive-ORing the data to be transmitted with the encryption key. The next step may be step 730 where the bit-sequences from channels A, B, and C may be combined.

In step 710, channel B data may be received and a bit-sequence may be generated by, for example, using a Viterbi algorithm. In step 712, the bit-sequence from step 710 may be decrypted by, for example, the decryption block 210. The next step may be step 730 where the bit-sequences from channels A, B, and C may be combined.

In step 720, channel C data may be received and a bit-sequence may be generated by, for example, using a Viterbi algorithm. In step 722, the bit-sequence from step 720 may be decrypted by, for example, the decryption block 210. The next step may be step 730 where the bit-sequences from channels A, B, and C may be combined.

In step 730, a bit-sequence from each of the steps 706, 712, and 722 may be combined to a single bit-sequence that may be a speech stream. If there are N bit-sequences from step 706, each of the N bit-sequences may be combined with the bit-sequence from step 712 and the bit-sequence from the step 722 to form N speech streams.

In step 732, the speech streams generated in step 730 may be tested by speech constraints. Speech constraints may be, for example, gain continuity and smoothness in inter-frames or intra-frames, pitch continuity in voice inter-frames or intra-frames, and/or consistency of line spectral frequency (LSF) parameters that are utilized to represent a spectral envelope. A single speech stream may be selected based on the speech constraints. The speech stream may be decoded by, for example, the AMR voice decoder 216.

Figure 7B:
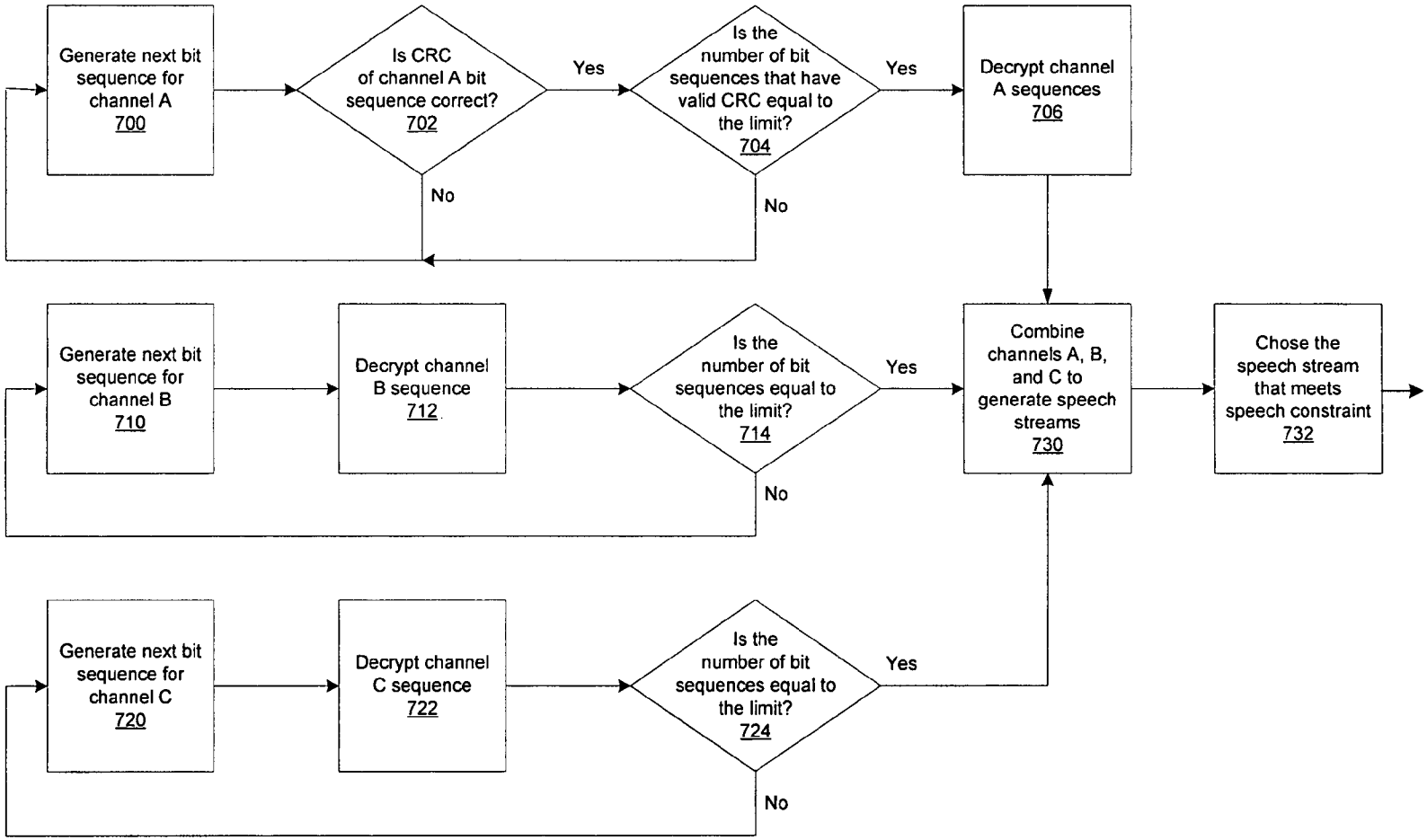
FIG. 7B is a flow chart illustrating exemplary steps for generating a speech stream in a WCDMA receiver, in accordance with an embodiment of the invention.

FIG. 7B is a flow chart illustrating exemplary steps for generating a speech stream in a WCDMA receiver, in accordance with an embodiment of the invention. FIG. 7B may be similar to FIG. 7A, however, the channels B and C may generate more than one bit-sequence. Accordingly, the steps 700, 702, 704, 706, 710, 712, 720, and 722 in FIG. 7B may be the similar to the corresponding steps in FIG. 7A.

Referring to FIG. 7B, the next step after step 706 may be step 730 where the bit-sequences from channels A, B, and C may be combined. The next step after step 712 may be step 714. In step 714, the number of bit-sequences for channel B may be determined to see if it's at a maximum number allowed. If there are less than a maximum number of bit-sequences, then the next step may be step 710 where a new bit-sequence may be generated. Otherwise, the next step may be step 730 where the bit-sequences from channels A, B, and C may be combined.

The next step after step 722 may be step 724. In step 724, the number of bit-sequences for channel C may be determined to see if it's at a maximum number allowed. If there are less than a maximum number of bit-sequences, then the next step may be step 720 where a new bit-sequence may be generated. Otherwise, the next step may be step 730 where the bit-sequences from channels A, B, and C may be combined.

In step 730, a bit-sequence from each of the steps 706, 716, and 726 may be combined to a single bit-sequence that may be a speech stream. If there are N_A bit-sequences from step 706, N_B bit-sequences from step 716, and N_C bit-sequences from step 726, the total number of speech streams that may be generated in step 730 may be (N_A)*(N_B)*(N_C).

In step 732, the speech streams generated in step 730 may be tested by speech constraints. Speech constraints may be, for example, gain continuity and smoothness in inter-frames or intra-frames, pitch continuity in voice inter-frames or intra-frames, and/or consistency of line spectral frequency (LSF) parameters that are utilized to represent a spectral envelope: A single speech stream may be selected based on the speech constraints. The speech stream may be decoded by, for example, the AMR voice decoder 216.

Another embodiment of the invention may provide a machine-readable storage, having stored thereon, a computer program having at least one code section executable by a machine, thereby causing the machine to perform the steps as described herein for decoding WCDMA AMR speech data using redundancy.

In accordance with an embodiment of the invention, aspects of an exemplary system may comprise convolution decoders, for example, the convolution decoders 202, 204, and 206, that enable generation of at least one bit-sequence. The bit-sequences may be generated by using a decoding algorithm for a plurality of channels that may comprise received WCDMA speech data. The bit-sequences may be decrypted by, for example, the decryption block 210. The decoding algorithm may be, for example, a Viterbi algorithm. For example, the WCDMA speech data may be separated in to three channels A, B, and C. The frame generator block 220 may enable selection of at least one bit-sequence for each of the plurality of channels, where at least one of the selected bit-sequences may be selected by using redundancy in the received WCDMA speech data. The channel combiner block 212 may enable combining of the selected bit-sequences for each of the plurality of channels to form at least one speech stream. The speech constraint checker/speech stream selector block 218 may enable selection of a speech stream that satisfies speech constraints to decode via a voice decoder, for example, the AMR voice decoder block 216. The speech constraints may comprise, for example, gain continuity and/or pitch continuity.

A processor, for example, the processor 112, may enable selection of at least one junction in a bit-sequence generated by the Viterbi algorithm. At least one source metric parameter may be used to select a junction, where the metric parameter may be a channel metric and/or a physical constraint metric. The processor 112 may also enable selection of the at least one bit-sequence by performing a search starting from each selected junction, where at least one bit-sequence may be selected after being verified by a corresponding redundancy verification parameter. The redundancy verification parameter may comprise, for example, a CRC.

The processor 112 may enable simultaneous generation of the corresponding redundancy verification parameter for each of the selected at least one bit-sequence and at least one trace back pointer used for performing the search starting from at least one of the selected at least one junction. The bit-sequences for each of the plurality of channels may be selected if the bit-sequence corresponds to a received CRC. The processor 112 may enable limiting a total number of CRC calculations carried out for selecting the bit-sequences by keeping count of the number of CRC calculations. The count may be stored in, for example, memory.

Accordingly, the present invention may be realized in hardware, software, or a combination of hardware and software. The present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method for signal processing, the method comprising:

generating, using a decoding algorithm, at least one bit-sequence for at least one of a plurality of channels comprising received WCDMA speech data;

selecting at least one said bit-sequence for each of said plurality of channels, wherein at least one of said selected at least one bit-sequence is selected using redundancy in said received WCDMA speech data;

combining said selected at least one bit-sequence for each of said plurality of channels to form at least one speech stream; and selecting a speech stream that satisfies speech constraints to decode via a voice decoder.

2. The method according to claim 1, wherein said decoding algorithm comprises a Viterbi algorithm.

3. The method according to claim 2, further comprising selecting at least one junction in said at least one bit-sequence generated by said Viterbi algorithm.

4. The method according to claim 3, further comprising selecting said at least one bit-sequence by performing a search starting from at least one of said selected at least one junction, wherein said at least one bit-sequence is selected when verified by a corresponding redundancy verification parameter.

5. The method according to claim 4, further comprising simultaneously generating said corresponding redundancy verification parameter for each of said selected at least one bit-sequence and at least one trace back pointer used for performing said search starting from said at least one of selected at least one junction.

6. The method according to claim 1, wherein said at least one bit-sequence for each of said plurality of channels is selected if said bit-sequence corresponds to a received CRC.

7. The method according to claim 6, further comprising limiting a total number of CRC calculations carried out for selecting said at least one bit-sequence.

8. The method according to claim 1, further comprising decrypting said at least one bit-sequence.

9. The method according to claim 1, wherein said speech constraint comprises gain continuity.

10. The method according to claim 1, wherein said speech constraint comprises pitch continuity.

11. A machine-readable storage having stored thereon, a computer program having at least one code section for signal processing, the at least one code section being executable by a machine for causing the machine to perform steps comprising:

generating, using a decoding algorithm, at least one bit-sequence for at least one of a plurality of channels comprising received WCDMA speech data;

selecting at least one said bit-sequence for each of said plurality of channels, wherein at least one of said selected at least one bit-sequence is selected using redundancy in said received WCDMA speech data;

combining said selected at least one bit-sequence for each of said plurality of channels to form at least one speech stream; and selecting a speech stream that satisfies speech constraints to decode via a voice decoder.

12. The machine-readable storage according to claim 11, wherein said decoding algorithm comprises a Viterbi algorithm.

13. The machine-readable storage according to claim 12, further comprising code for selecting at least one junction in said at least one bit-sequence generated by said Viterbi algorithm.

14. The machine-readable storage according to claim 13, further comprising code for selecting said at least one bit-sequence by performing a search starting from at least one of said selected at least one junction, wherein said at least one bit-sequence is selected when verified by a corresponding redundancy verification parameter.

15. The machine-readable storage according to claim 14, further comprising code for simultaneously generating said corresponding redundancy verification parameter for each of said selected at least one bit-sequence and at least one trace back pointer used for performing said search starting from at least one of said selected at least one junction.

16. The machine-readable storage according to claim 11, wherein said at least one bit-sequence for each of said plurality of channels is selected if said bit-sequence corresponds to a received CRC.

17. The machine-readable storage according to claim 16, further comprising code for limiting a total number of CRC calculations carried out for selecting said at least one bit-sequence.

18. The machine-readable storage according to claim 11, further comprising code for decrypting said at least one bit-sequence.

19. The machine-readable storage according to claim 11, wherein said speech constraint comprises gain continuity.

20. The machine-readable storage according to claim 11, wherein said speech constraint comprises pitch continuity.

21. A system for signal processing, the system comprising:

a convolution decoder that enables generation using a decoding algorithm of at least one bit-sequence for at least one of a plurality of channels comprising received WCDMA speech data;

a first circuitry that enables selection of at least one said bit-sequence for each of said plurality of channels, wherein at least one of said selected at least one bit-sequence is selected using redundancy in said received WCDMA speech data;

a combiner that enables combining of said selected at least one bit-sequence for each of said plurality of channels to form at least one speech stream; and a speech streams selector that enables selection of a speech stream that satisfies speech constraints to decode via a voice decoder.

22. The system according to claim 21, wherein said decoding algorithm comprises a Viterbi algorithm.

23. The system according to claim 22, further comprising at least one processor that enable selection of at least one junction in said at least one bit-sequence generated by said Viterbi algorithm.

24. The system according to claim 23, wherein said at least one processor enables selection of said at least one bit-sequence by performing a search starting from at least one of said selected at least one junction, wherein said at least one bit-sequence is selected when verified by a corresponding redundancy verification parameter.

25. The system according to claim 24, wherein said at least one processor enables simultaneous generation of said corresponding redundancy verification parameter for each of said selected at least one bit-sequence and at least one trace back pointer used for performing said search starting from said at least one of said selected at least one junction.

26. The system according to claim 21, wherein said at least one bit-sequence for each of said plurality of channels is selected if said bit-sequence corresponds to a received CRC.

27. The system according to claim 26, further comprising a second circuitry that enables limiting a total number of CRC calculations carried out for selecting said at least one bit-sequence.

28. The system according to claim 21, further comprising a decryptor that enables decryption of said at least one bit-sequence.

29. The system according to claim 21, wherein said speech constraint comprises gain continuity.

30. The system according to claim 21, wherein said speech constraint comprises pitch continuity.

* * * * *

UNITED STATES PATENT AND TRADEMARK OFFICE

CERTIFICATE OF CORRECTION

PATENT NO. : 7,643,993 B2
APPLICATION NO. : 11/325721
DATED : January 5, 2010
INVENTOR(S) : Arie Heiman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1024 days.

Signed and Sealed this
Fifteenth Day of March, 2011

David J. Kappos

David J. Kappos
*Director of the United States Patent and Trademark Office*